US010844445B2

(12) United States Patent
Lourenço

(10) Patent No.: US 10,844,445 B2
(45) **Date of Patent: *Nov. 24, 2020**

(54) CHROME TANNING PROCESS

(71) Applicant: TECHPOLYMERS INDUSTRIA E COMERCIO Ltda, Sao Bernardo Do Campo-SP (BR)

(72) Inventor: Wagner Célio Ferraz Lourenço, Paulinia (BR)

(73) Assignee: TECHPOLYMERS INDUSTRIA E COMERCIO Ltda, Sao Bernardo Do Campo (BR)

( * ) Notice: Subject to any disclaimer, the term of this patent is extended or adjusted under 35 U.S.C. 154(b) by 0 days.

This patent is subject to a terminal disclaimer.

(21) Appl. No.: 15/025,853

(22) PCT Filed: Sep. 30, 2014

(86) PCT No.: PCT/IB2014/001960

§ 371 (c)(1),
(2) Date: Mar. 29, 2016

(87) PCT Pub. No.: WO2015/044766

PCT Pub. Date: Apr. 2, 2015

(65) Prior Publication Data

US 2016/0244853 A1 Aug. 25, 2016

(30) Foreign Application Priority Data

Sep. 30, 2013 (EP) ..... 13186724

(51) Int. Cl.
*C14C 3/06* (2006.01)
*C14C 1/08* (2006.01)

(52) U.S. Cl.
CPC . *C14C 3/06* (2013.01); *C14C 1/08* (2013.01)

(58) Field of Classification Search
CPC .... C14C 3/06; C14C 1/08; C14C 3/02; C14C 3/28
See application file for complete search history.

(56) References Cited

U.S. PATENT DOCUMENTS 2,693,996 A * 11/1954 Von Fuchs ..... C14C 9/00 8/94.22
3,996,292 A * 12/1976 Decor ..... C14C 45/41 568/490
4,042,321 A 8/1977 Backer et al.
4,101,271 A * 7/1978 Bockelman ..... C14C 3/06 8/94.26
4,187,074 A * 2/1980 Traubel ..... C08G 18/0814 521/158
4,715,861 A 12/1987 Lotz et al.
4,938,779 A * 7/1990 Friese ..... C14C 3/06 8/94.19 R
4,978,361 A 12/1990 Fuchs et al.
5,500,020 A 3/1996 Bandino
5,885,302 A 3/1999 Leuck
2005/0268671 A1* 12/2005 Lourenco ..... C14C 3/06 69/21
2009/0172890 A1* 7/2009 Huffer ..... C14C 3/16 8/94.17
2010/0076124 A1* 3/2010 Yawata ..... C07D 339/02 524/84
2010/0119775 A1* 5/2010 Bustos ..... C08G 18/0823 428/151

FOREIGN PATENT DOCUMENTS

BR 9603419-0 A 6/1998
BR 9702025-7 A 6/1998
CN 102517407 A 6/2012
CN 102776300 A 11/2012
EP 822263 B1 10/1999
WO WO 9606878 A1 * 3/1996 ..... A61Q 17/04
WO 20040015148 A1 2/2004
WO WO 2004015148 A1 * 2/2004 ..... C14C 3/06

OTHER PUBLICATIONS

First Office Action dated Feb. 27, 2017, issued by The State Intellectual Property Office of The Peoples Republic of China (SIPO) in corresponding Chinese Patent Application No. CN-201480054100.0, with USPTO Global Dossier English translation (12 pages).
Second Office Action dated Oct. 31, 2017, issued by the State Intellectual Property Office of the Peoples Republic of China (SIPO) in corresponding Chinese Patent Application No. CN-201480054100.0, with USPTO Global Dossier English translation (10 pages).

* cited by examiner

*Primary Examiner* — Vasuvedan S Jagannathan
*Assistant Examiner* — Preeti Kumar
(74) *Attorney, Agent, or Firm* — Osha Bergman Watanabe & Burton LLP

(57) ABSTRACT

The invention concerns a process for tanning hide to obtain leather. The general process for obtaining the intermediary wet blue stage comprises the following steps: a) a picking step with acid and salt, followed by b) a tanning step with chromium salt, followed by c) a basification step. The invention is characterized in that between step b) and c), a re-acidification step with organic acids is added. In particular the organic acids are selected from glutaric acid (GA), 2-methyl glutaric acid (MGA), succinic acid, ethyl succinic acid (ESA), adipic acid (AA), maleic anhydride, fumaric anhydride, tricarboxylic acids, hydroxycarboxylic acids, and mixture thereof. This invention enables an increase of the up-taking of the re-tanning products and provides leather with improved mechanical properties.

10 Claims, 2 Drawing Sheets

CHROME TANNING PROCESS

Figure 1A:
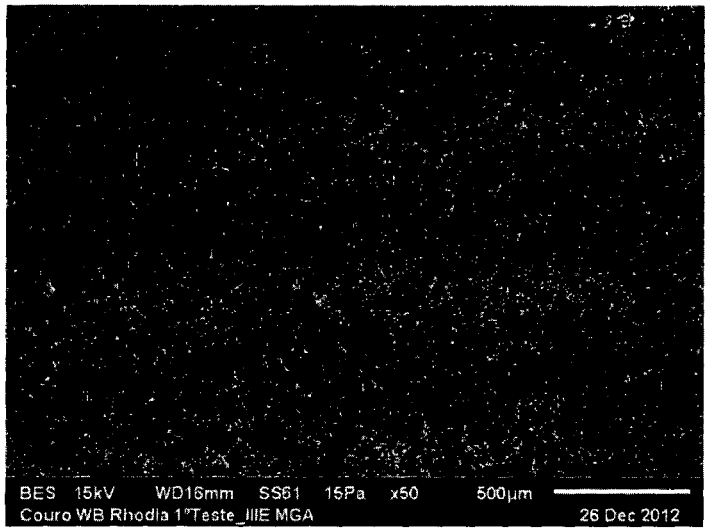

This application is a U.S. national stage entry under 35 U.S.C. § 371 of International Application No. PCT/162014/001960, filed Sep. 30, 2014, which claims priority to Application No. EP 13186724.4 filed on Sep. 30, 2013. The entire content of each of these applications is hereby incorporated herein by reference.

The present invention is related to a process of tanning hide to obtain leather. More specifically, it refers to an improvement introduced in the conventional process of tanning hide with chrome to obtain better quality leather. The advantages of the present invention are obtained with an additional acidification step after the chromium tanning step.

STATE OF THE ART

Hide tanning is a process in which the collagen protein present therein reacts with tanning agents, originating leather—the tanning process is therefore one of the essential steps in leather production process. It is a very old process, whose purpose is to avoid hide degradation and putrefaction, by means of a protein crosslinking phenomenon caused by the action of the employed tanning agent.

For chrome tanning producing "Wet Blue" (an intermediary stage prior to obtaining the final leather), traditionally used tanning agents are chrome III salts, such as chrome sulfate or basic chrome sulfate. Typically, leather has already been tanned when the hide incorporates about 3.5% by weight of chrome oxide, $Cr_20_3$, dry basis, thus obtaining retraction test resistant leathers.

In the traditional processes of tanning hide, only 70% to 80% of chrome oxide available in the tanning bath is used. This means that the use of a large excess of salt is required, imposing additional costs to the process and generating an undesirable residue, potentially causing damaging impact to the environment and requiring storage and/or chemical treatment before disposal.

Despite the fact that chrome III compounds are not damaging to plants and animals, especially under neutral conditions, international rules impose low limits to the presence of chrome III and other heavy metals in water and air.

American patents U.S. Pat. Nos. 4,715,861 and 4,978,361 describe better hide absorption of chrome by hide by means of supplementary addition of chemical compounds. American patent U.S. Pat. No. 4,042,321 proposes recycling the tanning bath by a complex and costly process aiming the reduction of effluents treatment, being, however, complicated due to the accumulation of salts and fiber residues. European patents EP 822,263 and Brazilian patents BR 9603419-0 and BR 9702025-7 disclose larger exhaustion of the chrome bath by the use of aldehyde, which is very toxic. As a rule, the state of the art always proposes more steps and/or the use of more raw materials to deal with the problem.

The traditional Chromium process from the animal hide to the final leather comprises the following step:

1. Liming, unhairing and fleshing the animal hide
2. Deliming and bating the hide obtained after step 1 generally with the use of ammonium salt and deliming agents
3. Pickling step: the hide is subjected to an acidification step in a bath comprising also a salt, usually sodium chloride 4. Tanning step: chromium salt is added in the bath during a time sufficient to enable the chromium ion to cross the hide cross-section
5. Basification step: a basifying agent is added in the bath which is then heated
6. After draining and washing a wet blue leather is obtained
7. Re-tanning step
8. Finishing steps (neutralization, dyeing, fixation, fatliquoring)
9. Obtaining the crust leather
10. Additional finishing steps
11. Obtaining final leather The inventor has now found that a re-acidification of the bath after the tanning step, with particular organic acids can improve the up-taking of re-tanning products (at step 7) and improve the mechanical properties of the crust and finished leather.

U.S. Pat. No. 4,938,779 discloses a Chrome tanning process of hides. After tanning step 4), a preliminary neutralization is performed by the addition of a mixture containing glyoxylic acid and MgO. A pH 3.9 is obtained after this addition. A basification step is then performed with alkali aluminum silicate. A pH 4.5 is then obtained. In this process, the neutralization begins when the Chrome has not yet completely crossed the hide cross-section.

BRIEF DESCRIPTION OF THE INVENTION

The object of the present invention is a process of tanning hides comprising:

a) a pickling step consisting of immerging the hides in a bath with acid and salt, followed by
b) a tanning step consisting of immerging the hides in a bath with chromium salt, followed by
c) a basification step consisting of immerging the hides in a bath with a basifying agent;

the process being characterized in that between step b) and c), a re-acidification step with organic acids is added. The organic acids are chosen among glutaric acid (GA), 2-methyl glutaric acid (MGA), succinic acid, 2-ethyl succinic acid (ESA), adipic acid (AA), maleic anhydride, fumaric anhydride, tricarboxylic acids, hydroxycarboxylic acids, and mixture thereof.

This re-acidification step lasts for a time sufficient to enable all the Chrome to cross the hide cross-section. The basification step only begins after all the Chrome has crossed the hide cross-section.

DETAILED DESCRIPTION OF THE INVENTION

Advantageous characteristics of the process can be found in the sub-claims and below.

In one preferred embodiment of the process according to the invention, the organic acids used in the re-acidification step comprise:

between 70 and 100 weight % of MGA;
between 0 and 30 weight % of ESA; and furthermore
between 0 and 15 weight % of AA.

In another preferred embodiment of the process according to the invention, the organic acids used in the re-acidification step comprise a mixture of adipic, glutaric and succinic acid.

In this case, the organic acids composition used in the re-acidification step advantageously comprise:

between 10 and 85 weight % of adipic acid,
between 10 and 70 weight % of glutaric acid, and
between 3 and 30 weight % of succinic acid.

In the process according to the invention, the amount of organic acids used in the re-acidification step is preferably comprised between 0.25% and 10% of the weight of the hide to be treated, more preferably between 0.5% and 5% of the weight of the hide to be treated and in particular between 0.7% and 3% of the weight of the hide to be treated.

It is particularly preferred that the pH obtained after the re-acidification step is comprised between 2.6 and 3.5, preferably between 2.6 and 3.

In the process according to the invention, the basifying step c) is preferably performed after the chrome has crossed the hide cross-section.

The re-acidification step is advantageously performed during a time comprised between 10 and 25 hours, in order to enable the chrome to cross the hide cross-section.

The pH obtained after the basifying step c) is preferably comprised between 3.6 and 4.2.

In the process according to the invention, the bath of the pickling step a) comprises, with regards to the weight of the hides to be treated:

between 25 and 75 weight % of water
between 3 and 12 weight % of NaCl, and
between 0.1 and 3 weight % of $H_2SO_4$.

Examples 1 to 3

Production of the Wet Blue Intermediary Stage

Example 1

100 kg of hide for which liming, unhairing and fleshing process are completed, is washed, in a tanning drum with the same weight of water for 10 minutes.

For all examples, all ingredients added thereafter are in weight pourcentage of the initial hide weight.

After the washing the water is discharged and the hides are submitted to deliming and bating with the use of ammonium sulfate and a commercial deliming agent based on di-carboxylic acids (Ex: Rhodiaeco Descal SD commercialized by Rhodia Poliamida e Especialidades Ltda.). After all, bating process takes place, adding 0.08% of a standard commercial proteolytic enzyme and the drum is run for 1 hour (pH=8.0). At the end of these operations the cross-section of the hide does not show a pink color with phenolphthalein indicator.

The hides are washed twice with 100% water, based on hide weight, and the washings are discharged.

Pickling Step

With relation to the hide weight, it is added into the drum, 50% of water, 6% of sodium chloride (Bé (Baumé scale) 6 to 7) and 0.4% of a commercial bleaching (run 15 minutes). 0.6% of 85% formic acid diluted in water (1 to 10) is added (run 30 minutes) followed by the addition of 0.3% of sulfuric acid diluted in water (1 to 15) (run 15 minutes), 0.3% of sulfuric acid diluted in water (1 to 15) (run 15 minutes) followed by the addition of 0.4% of sulfuric acid diluted in water (1 to 15) and the drum is run for an additional 3 hours. After this time the pH of the bath is around 2 to 3.

Tanning Step

At this point a 3% of commercial chromium sulphate salt (ex: basic chromium sulphate, which presents 33% alkalinity and 25 to 26% chrome III oxide) is added (run 30 minutes). A second addition of 3% of chromium sulphate salt is added and the drum is run for additional 30 minutes followed by the addition of 0.75% of a mixture of 2-methyl glutaric acid (MGA), 2-ethyl succinic acid (ESA) and adipic acid (AA). A pH of 2.6 to 2.8 is then obtained. After 17 hours, the chromium has completely crossed the hide cross-section.

Basifying Step

After this time, 20% of water is added and 0.35% of a commercial basifying agent (ex: magnesium oxide) (run 90 minutes). A second portion of 0.23% of magnesium oxide is added and the drum is run for an additional 90 minutes. A pH of 3.6 to 4 is then obtained. The water bath is heated from 35° C. to 50° C. during 5 hours, the drum is drained, the wet blue is washed with 100% water (based on pelt weight), drained and washed again with 80% water.

The obtained Wet Blue was submitted to the analysis of total chromium content, chromium in layers and evaluation by Scanning Electron Microscope (EDS) (Table 1 and FIG. 1*a*).

Example 2

500 kg of hide for which liming, unhairing and fleshing process are completed, is washed in a tanning drum with 100% water (based on pelt weight) for 10 minutes. After that, the hides were submitted to deliming and batting according to example 1.

With relation to the hide weight, it is added into the drum, 50% of water, 6% of sodium chloride (Bé 6 to 7) and 0.4% of a commercial bleaching (run 15 minutes). 0.6% of 85% formic acid diluted in water (1 to 10) is added (run 30 minutes) followed by the addition of 0.3% of sulfuric acid diluted in water (1 to 15) (run 15 minutes), 0.3% of sulfuric acid diluted in water (1 to 15) (run 15 minutes) followed by the addition of 0.4% of sulfuric acid diluted in water (1 to 15) and the drum is run for an additional 3 hours. After this time the pH of the bath is around 2 to 3.

At this point a 3% of commercial chromium sulphate salt (ex: basic chromium sulphate, which presents 33% alkalinity and 25 to 26% chrome III oxide) is added (run 30 minutes). A second addition of 3% of chromium sulphate salt is added and the drum is run for additional 30 minutes followed by the addition of 2.5% of an aqueous solution of a mixture of 2-methyl glutaric acid (MGA), 2-ethyl succinic acid (ESA) and adipic acid (AA). A pH of 2.6 to 2.8 is then obtained. After 17 hours, the chromium has completely crossed the hide cross-section.

After this time, 20% of water is added and 0.35% of a commercial basifying agent (ex: magnesium oxide) (run 90 minutes). A second portion of 0.23% of magnesium oxide is added and the drum is run for an additional 90 minutes. The water bath is heated from 35° C. to 50° C. during 5 hours, the drum is drained, the wet blue is washed with 100% water (based on pelt weight), drained and washed again with 80% water.

Example 3 (Comparative Example)

100 kg of hide for which liming, unhairing and fleshing process are completed, is washed in the tanning drum with 100% water (based on pelt weight) for 10 minutes. After that, the hides were submitted to deliming and batting according to example 1.

With relation to the hide weight, 60% of water, 6% of sodium chloride (Bé 6 to 7) and 0.4% of a commercial bleaching are added and the drum is run for 15 minutes. 0.6% of 85% formic acid diluted in water (1 to 10) is added (run 30 minutes) followed by the addition of 0.3% of sulfuric acid diluted in water (1 to 15) (run 15 minutes), 0.3% of sulfuric acid diluted in water (1 to 15) (run 15 minutes), followed by the addition of 0.4% of sulfuric acid diluted in water (1 to 15) and the drum is run for an additional 3 hours. After this time the pH of the bath is around 2.7 to 3.

At this point a 3% of commercial chromium sulphate salt (ex: basic chromium sulphate, which presents 33% alkalinity and 25 to 26% chrome III oxide) is added (run 30 minutes). A second addition of 3% of chromium sulphate salt is added and the drum is run for an additional 17 hours after which time the chromium has completely crossed the hide cross-section.

After this time, 20% of water is added and 0.35% of a commercial basifying agent (ex: magnesium oxide) (run 90 minutes). A second portion of 0.27% of magnesium oxide is added and the drum is run for an additional 90 minutes. The water bath is heated from 35° C. to 50° C. during 5 hours, the drum is drained, the wet blue is washed with 100% water (based on pelt weight), drained and washed again with 80% water.

Figure 1B:
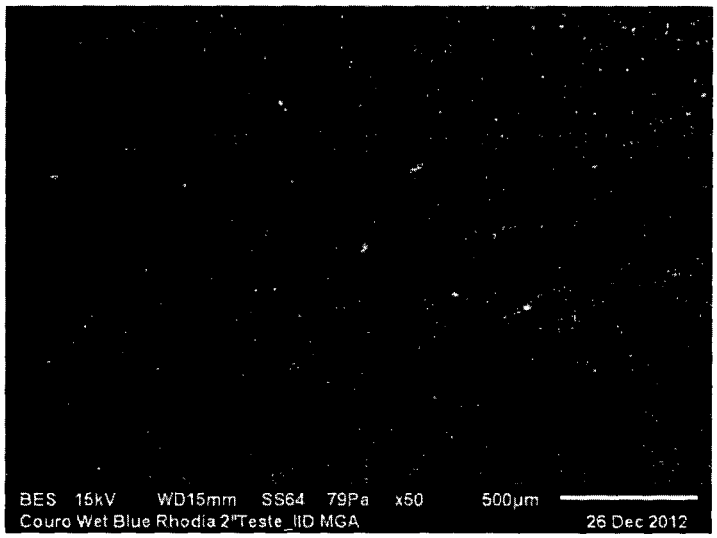

The obtained Wet Blue was submitted to the analysis of the total chromium content, chromium in layers and evaluation by Scanning Electron Microscope (EDS) (Table 1 and FIG. 1*b*).

Example 4

Production of the Retanned Hides (Crust Step) of Examples 1 to 3

The Wet Blue obtained in the examples 1 and 3 are identified by different marks, combined and submitted to a standard re-tanning process. The Wet Blue hides are placed in the drum, and washed with 200% of water at 30° C. (based on Wet Blue weight) for 30 minutes and the washing is drained.

150% of water, 2% of sodium formiate and 0.3% of sodium bicarbonate are added and the drum is run for 60 minutes after which time the water bath shows a pH=4.4.

The water bath is drained and 60% of water at 30° C., 2% of a commercial polyacrylate (powder) are added and the drum is run for 60 minutes and the water bath is drained.

150% of water at 60° C., 2% of commercial sulfited synthetic oil, 2% of commercial sulfated emulsified vegetal oil are added, the drum is run for 45 minutes and the water bath is drained.

0.3% of 85% formic acid diluted in water (1 to 5) is added (run 20 minutes), the water bath is drained and the re-tanned hides are washed.

The re-tanned hides are left standing for 12 hours, stretched, naturally dried and softened.

Figure 2A:
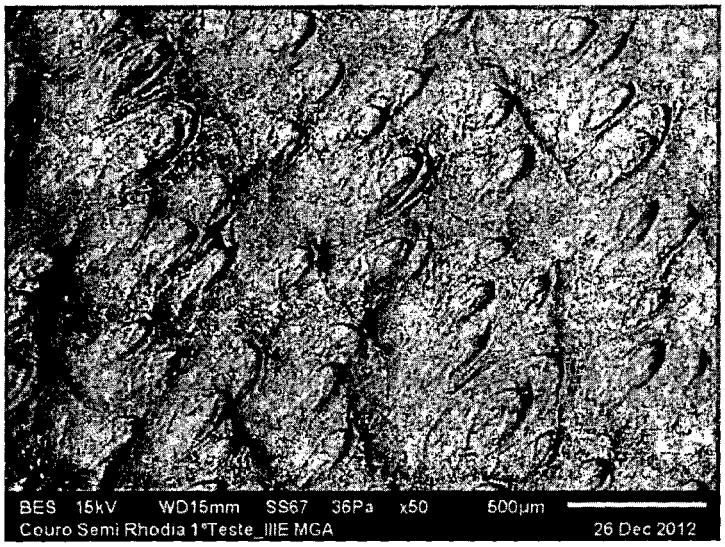
Figure 2B:
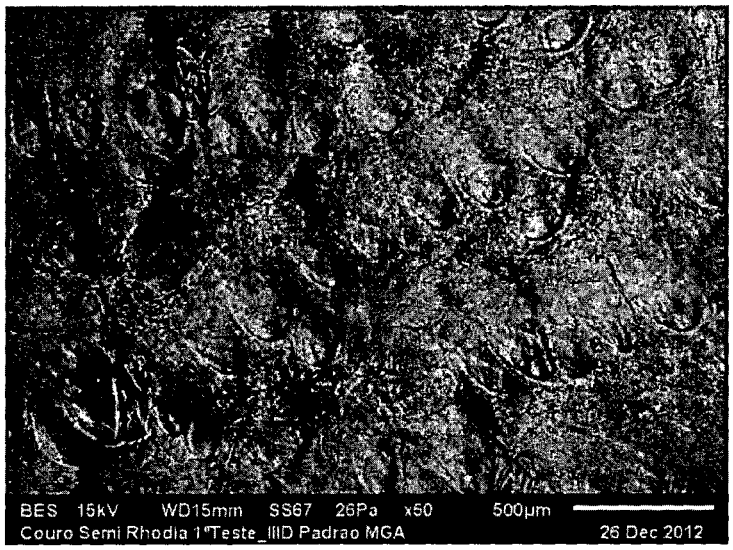

The properties of the re-tanned hides are evaluated and compared concerning tensile strength, breaking strength, tear strength, progressive tensile strength, up-taking of re-tanning products based on a square foot weight of crust, light fastness, color appearance and comparative evaluation by Scanning Electron Microscope (EDS) (Tables 2 to 4 and FIG. 2).

Examples 5 and 6

Production of the Wet Blue Intermediary Stage

Example 5

250 kg of hide for which liming, unhairing and fleshing process are completed, is washed in the tanning drum with 100% of water (based on pelt weight) for 10 minutes. After that, the hides are submitted to deliming and batting according to example 1.

With relation to the hide weight, 50% of water, 6% of sodium chloride (Bé 6 to 7) and 0.4% of a commercial bleaching are added and the drum is run for 15 minutes. 0.6% of 85% formic acid diluted in water (1 to 10) is added (run for 30 minutes) followed by the addition of 0.3% of sulfuric acid diluted in water (1 to 15) (run 15 minutes), 0.3% of sulfuric acid diluted in water (1 to 15) (run 15 minutes) followed by the addition 0.4% of sulfuric acid diluted in water (1 to 15) and the drum is run for 3 hours. After this time the pH of the bath is around 2 to 3.

At this point a 3% of commercial chromium sulphate salt (ex: basic chromium sulphate, which presents 33% alkalinity and 25 to 26% chrome III oxide) is added (run 30 minutes. A second addition of 3% of chromium sulphate salt is added (run 30 minutes) followed by the addition of 0.70% of Dioro (commercial product from Rhodia Poliamida e Especialidades Ltda. based on a mixture of di-carboxylic acids) and the drum is run for an additional 12 hours after which time the chromium has completely crossed the hide cross-section.

After this time, 20% of water is added and 0.35% of a commercial basifying agent (ex: magnesium oxide) (run 90 minutes). A second portion of 0.35% of magnesium oxide is added and the drum is run for an additional 90 minutes. The water bath is heated from 35° C. to 50° C. during 5 hours, the drum is drained, the wet blue is washed with 100% of water (based on pelt weight), drained and washed again with 80% of water.

The obtained Wet Blue was submitted to the analysis of the total chromium content and chromium in layers (Table 1).

Example 6 (Comparative Example)

250 kg of hide for which liming, unhairing and fleshing process are completed, is washed in a tanning drum with 100% of water (based on pelt weight) for 10 minutes. After that, the hides are submitted to deliming and batting according to example 1.

With relation to the hide weight, 50% of water, 6% of sodium chloride (Bé 6 to 7) and 0.4% of a commercial bleaching are added and the drum is run for 15 minutes. 0.6% of 85% formic acid diluted in water (1 to 10) is added (run 30 minutes) followed by the addition of 0.3% of sulfuric acid diluted in water (1 to 15) (run 15 minutes), 0.3% of sulfuric acid diluted in water (1 to 15) (run 15 minutes), followed by the addition of 0.4% sulfuric acid diluted in water (1 to 15) and the drum is run for an additional 3 hours. After this time the pH of the bath is around 2.7 to 3.

At this point a 3% of commercial chromium sulphate salt (ex: basic chromium sulphate, which presents 33% alkalinity and 25 to 26% chrome III oxide) is added (run 30 minutes). A second addition of 3% of chromium sulphate salt is added and the drum rum for an additional 12 hours after which time the chromium has completely crossed the hide cross-section.

After this time, 20% of water is added and 0.35% of a commercial basifying agent (ex: magnesium oxide) (run 90 minutes). A second portion of 0.35% magnesium oxide is added and the drum is run for an additional 90 minutes. The water bath is heated from 35° C. to 50° C. during 5 hours, the drum is drained, the wet blue is washed with 100% of water (based on pelt weight), drained and washed again with 80% of water.

Example 7

Production of the Retanned Hides (Crust Step) of Examples 5 and 6

The Wet Blue obtained in the examples 5 and 6 are identified, combined and submitted to a standard re-tanning process according to example 4.

Results

The properties of the re-tanned hides are evaluated and compared concerning tensile strength, breaking strength, tear strength, progressive tensile strength, up-taking of re-tanning products based on a square foot weight of crust, light fastness and color appearance (Tables 2 to 4).

TABLE 1

Analysis of chromium in the final Wet Blue

| | 3.5% minimum | | |
|---|---|---|---|
| Reference Value | Example 3 | Example 1 | Example 5 |
| Dermis | 4.2 | 4.0 | 3.8 |
| Middle | 3.5 | 3.0 | 2.6 |
| Epidermis | 4.3 | 3.7 | 3.9 |
| Layers Average | 4.0 | 3.6 | 3.4 |

FIG. 1 represent Scanning Electron Microscope (EDS) of Wet Blue samples.

FIG. 1.*a* is a wet blue according to example 1 of the invention

FIG. 1.*b*. is a wet blue according to comparative example 3

TABLE 2

Comparative weight of crust leather

| | Example 1 compared to Example 3 after re-tanning | Example 5 compared to Example 6 after re-tanning |
|---|---|---|
| Crust mass variation (up taking of re-tanning products) | +8.2 g | +5.8 g |
| Percentage Variation | 14% | 12% |

TABLE 3

Comparative physical-mechanical properties of crust leather

| | | Measurements | Minimum Values | Example 3 after re-tanning | Example 1 after re-tanning | Example 5 after re-tanning |
|---|---|---|---|---|---|---|
| Tensile Strenght IULTCS IUP6/ISO 3376:2011 | Direction A | Breaking Strenght (N) | 150 | 192.1 | 347.5 | 143.5 |
| | | Tension Strenght (N/mm2) | 15 to 18 | 15.8 | 26 | 13.5 |
| | Direction B | Breaking Strenght (N) | | 230.6 | 168.7 | 176 |
| | | Tension Strenght (N/mm2) | | 19.8 | 12.3 | 16.3 |
| Progressive Tensile Strenght IULTCS 8/ISO 3372-2:2002 | | Tear Strenght (N) | 50 | 68.4 | 103 | 84.2 |
| | | Specific strength (N/mm) | 49.1 | 59.2 | 73.5 | 84.3 |

Comparative light fastness

| | Example 3 after re-tanning | Example 1 after re-tanning | Example 5 after re-tanning |
|---|---|---|---|
| Light Fastness | 4 | >4 | >4 |

NOTES:

Xenon Lamp (Method EN ISO 105-B02:2002)

Total exposure time: 24 hours, Filter Ultraviolet

Irradiance: 445 W/m$^2$ in 300 to 800 nm

After the test the specimens were kept at least 1 hour in the dark in a conditioned environment at 23+/−2° C. and air relative humidity of 50+/−5%.

FIG. 2 represent Scanning Electron Microscope (EDS) of Crust samples

FIG. 2.*a* is a crust from wet blue according to example 1 of the invention

FIG. 2.*b*. is a crust from wet blue according to comparative example 3

CONCLUSIONS

The above results show the improvement brought with the present invention with regards to the up-taking of retanning products as well as the gain in mass of crust. The invention also enables better physical-mechanical properties of crust and final leather.

The invention claimed is:

1. A process for tanning hides, comprising:

a) immerging the hides in a bath with acid and salt, followed by b) immerging the hides in a bath with chromium salt, and subsequently c) immerging the hides in a bath with a basifying agent;

further comprising, between step b) and step c), re-acidifying the bath of step b) with organic acids, wherein the organic acids comprise a mixture of 2-methyl glutaric acid, 2-ethyl succinic acid, and adipic acid, and wherein, after re-acidifying the bath of step b) of the process and prior to performing step c) of the process, the pH of the bath is between 2.6 and 3.5.

2. The process according to claim 1, wherein the amount of organic acids used in re-acidifying the bath of step b) of the process comprises between 0.25% and 10%, based on the weight of the hides.

3. The process according to claim 2, wherein the amount of organic acids used in re-acidifying the bath of step b) of the process comprises between 0.5% and 5%, based on the weight of the hides.

4. The process according to claim 3, wherein the amount of organic acids used in re-acidifying the bath of step b) of the process comprises between 0.7% and 3%, based on the weight of the hides.

5. The process according to claim 1, wherein the chromium salt comprises a chromium ion, the hides have a hide cross-section, and step c) of the process is performed after the chromium ion has crossed the hide cross-section.

6. The process according to claim 5, re-acidifying the bath of step b) of the process is performed between 10 and 25 hours after step b).

7. The process according to claim 1, wherein the pH of the bath of step c) of the process is between 3.6 and 4.2.

8. The process according to claim 1, wherein the bath of step a) of the process comprises, based on the weight of the hides:

between 25 and 75 weight % of water, between 3 and 12 weight % of NaCl, and between 0.1 and 3 weight % of $H_2SO_4$.

9. The process according to claim 1, wherein, after re-acidifying the bath of step b) of the process and prior to performing step c) of the process, the pH of the bath is between 2.6 and 3.

10. The process according to claim 1, wherein the organic acids comprise a mixture of:

at least 70 weight % of 2-methyl glutaric acid;

greater than 0 and at most 30 weight % of 2-ethyl succinic acid; and greater than 0 and at most 15 weight % of adipic acid.

* * * * *